United States Patent [19]

Thomson

[11] 3,978,961

[45] Sept. 7, 1976

[54] TYPEWRITER CARRIAGE ACTUATING MECHANISM

[75] Inventor: James E. Thomson, Pleasant Lake, Mich.

[73] Assignee: Western Stamping Corporation, Jackson, Mich.

[22] Filed: Apr. 21, 1975

[21] Appl. No.: 570,167

[52] U.S. Cl. ..... 197/89; 197/92

[51] Int. Cl.[2] ..... B41J 19/26

[58] Field of Search ..... 197/82, 88, 89, 94, 197/92

[56] References Cited

UNITED STATES PATENTS

| | | | |
|---|---|---|---|
| 752,753 | 2/1904 | Moya | 197/89 |
| 2,007,359 | 7/1935 | Berger | 197/89 |
| 2,186,048 | 1/1940 | Sweeney et al. | 197/89 X |
| 2,287,185 | 6/1942 | Lohr | 197/89 |
| 3,441,119 | 4/1969 | Schweizer | 197/94 |

*Primary Examiner*—Edgar S. Burr
*Assistant Examiner*—Paul T. Sewell
*Attorney, Agent, or Firm*—Harness, Dickey & Pierce

[57] ABSTRACT

Typewriter carriage actuating mechanism includes ratchet teeth which are successively pushed by an actuating-type pawl to move the carriage. The actuating pawl is swingable toward and away from the ratchet teeth, to permit the teeth to move beneath it, and is also movable parallel to the path of carriage movement to actuate the carriage. A detent pawl positions the carriage after each forward actuation and prevents reverse movement thereof. The teeth and the tooth-engaging portions of the pawls are inclined in such manner that the carriage is movable in both directions by force applied directly to the carriage. At such time the ratchet teeth cam the pawls out of the spaces between the teeth.

8 Claims, 5 Drawing Figures

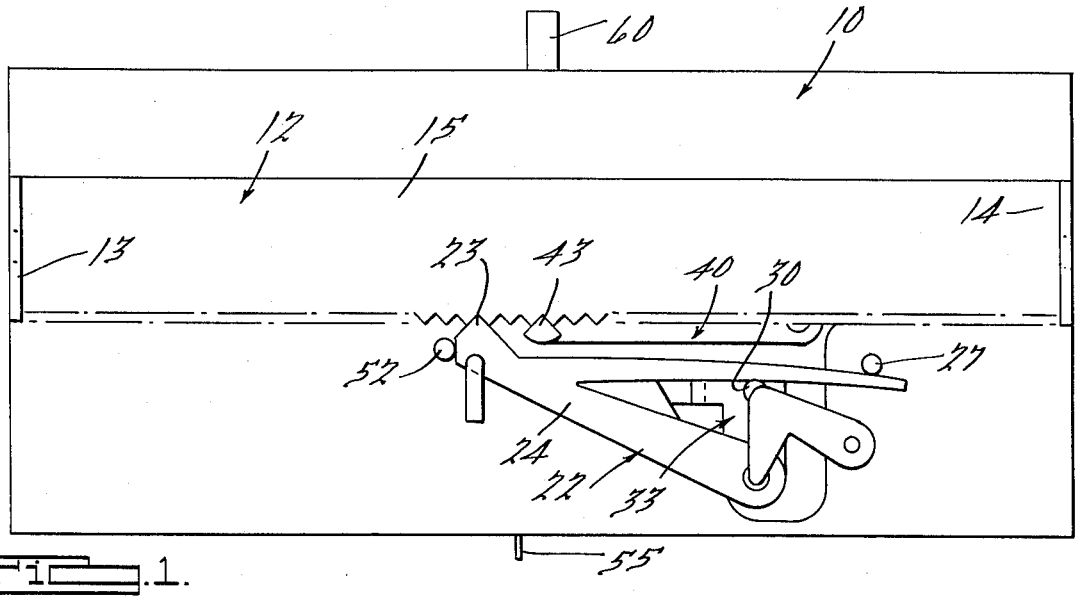
Fig. 1.
Fig. 2.
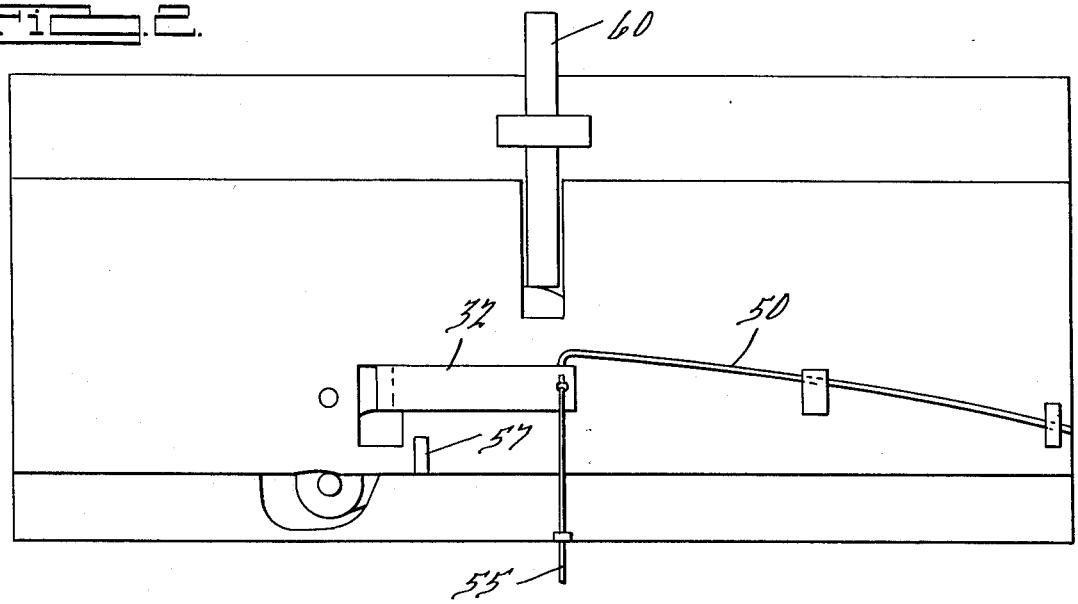

TYPEWRITER CARRIAGE ACTUATING MECHANISM

BACKGROUND OF THE INVENTION

In the construction of typewriter carriage actuating mechanisms it has been usual to employ as the carriage driving force a relatively long coiled spring or an encased spiral spring of the clock-spring type, relatively complex escapement and pawl means being used, in conjunction with ratchet teeth on the carriage, to control the movement of the carriage by the spring. Such arrangements have required very precise and delicate adjustments of a pair of pawls or the like, one of which is used to release the carriage for a partial movement, amounting to less than one full tooth, under the influence of the spring, and the other pawl functioning to arrest and hold the carriage in the desired position after one full tooth has passed. The prior art mechanisms referred to are not only relatively expensive and delicate, but render it difficult to maintain highly accurate positioning of the carriage, particularly after wear has occurred. In addition, blurred impressions are sometimes created due to slight movement of the carriage while the type bar is striking the paper.

The present invention aims to provide an improved carriage-actuating mechanism wherein the carriage is accurately moved through a distance of one full tooth, by a pawl, no carriage return spring being required, the arrangement being such that any wear which occurs between the pawl and ratchet teeth cannot interfere with proper operation of the mechanism.

A further object is to provide such a mechanism which is simple, rugged and inexpensive, and which permits movement of the carriage in either direction without damage to the parts by force applied directly thereto without the necessity of releasing pawl or escapement components from engagement with the ratchet teeth.

Another object is to provide such a mechanism in which forward movement of a type bar does not cause any movement of the carriage, and in which all movement of the carriage occurs during the return stroke of the type bar, a full, exact and uniform movement being assured, so that blurring does not occur, and the carriage can always be returned accurately to any previous position.

Another object is to provide such a mechanism which is particularly suitable for toy typewriters and which, by achieving both lower cost and better performance, makes it possible to sell such machines, which have a high educational value, at lower cost to the purchaser.

Other objects and advantages will become apparent upon consideration of the present disclosure in its entirety.

BRIEF DESCRIPTION OF THE FIGURES OF DRAWING

FIG. 1 is a fragmentary top plan view, partly broken away, of a typewriter carriage actuating mechanism constructed in accordance with the present invention and showing related connected parts;

FIG. 2 is a bottom plan view;

DETAILED DESCRIPTION OF THE PREFERRED FORM OF THE INVENTION

Figure 3:
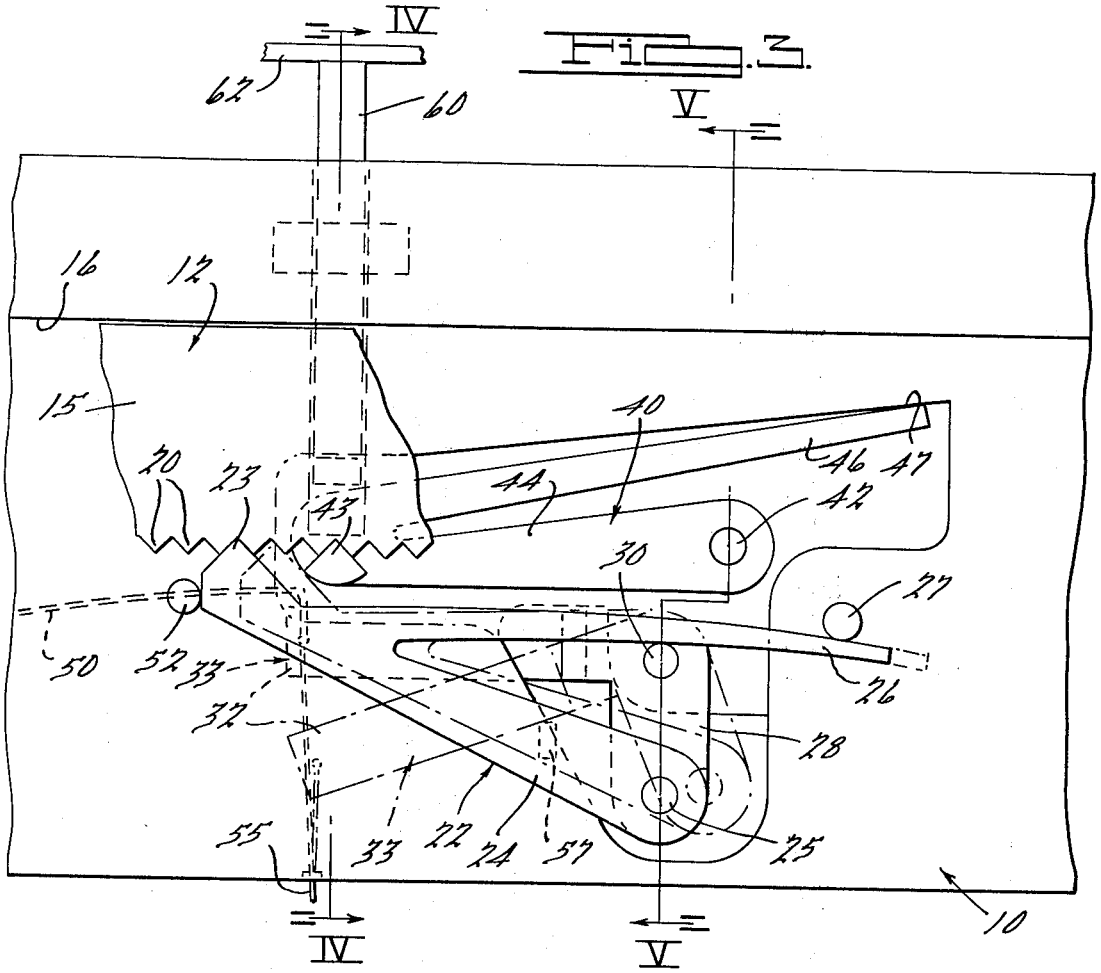
FIG. 3 is a somewhat diagrammatic plan view showing the operative components on a larger scale.
Figure 4:
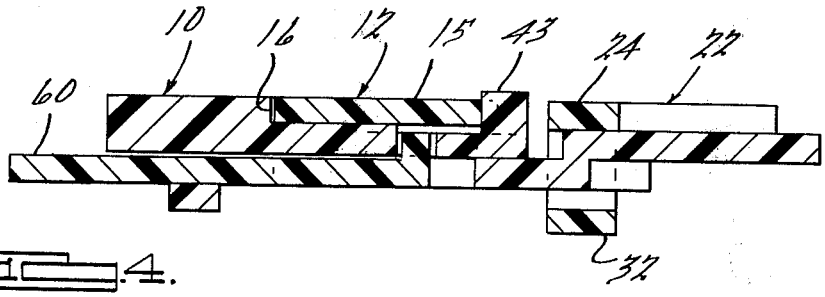
FIGS. 4 and 5 are cross-sectional views taken substantially on the lines IV—IV and V—V of FIG. 3, respectively, and looking in the direction of the arrows.
Figure 5:
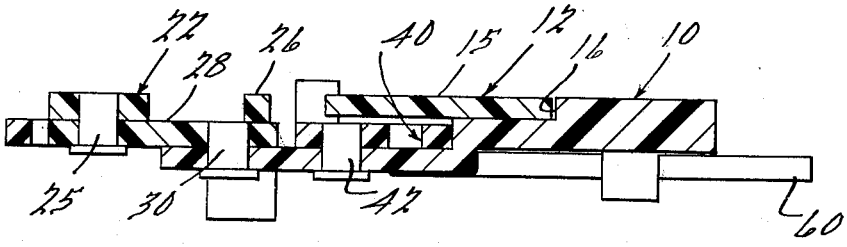

Reference character 10 designates generally a portion of the supporting frame structure of a typewriter, the illustrated portion of which is a flat and horizontal plate-like member formed of a rigid material such as a suitable plastic having good low-friction bearing characteristics. The construction shown is particularly suitable for toy typewriters, in the manufacture of which the designer may wish to utilize plastic components for all of the major components of the mechanism of my invention, and they are disclosed as such; but it will be recognized that metal construction, antifriction bearings, etc., could easily be used by the designer in modified structural applications of the invention.

Reference character 12 designates generally a main supporting portion of a carriage which is transversely slidable in and supported by frame portion 10 and which has at its ends integral upturned arms 13, 14 in which a platen (not shown) is journaled in the conventional or any suitable manner. The bottom portion 15 of the carriage is in the form of a straight flat section which is slidably guided in the supporting portion 10, the portion 10 being recessed, as indicated at 16, to provide a guiding wall for the carriage member 12. As viewed in FIGS. 1, 2 and 3 the rear of the typewriter may be presumed to be toward the top of the sheet, while the front and keyboard section would be below the portions shown in these views. The terms "front" and "rear", "left" and "right" will be used in this connotation. Along the front edge of the carriage-supporting portion 12 a series of uniform ratchet teeth are provided, designated 20, which have straight sides at 90° to each other and which accordingly lie at 45° to the rectilinear path of movement of the carriage.

During typing the carriage is moved in a forward direction, toward the left in FIGS. 1 and 3, by a pusher pawl, generally designated 22, which has a nose portion 23 shaped conformably to and adapted to fit into the spaces between the teeth 20. The body portion 24 of pawl 22 slopes angularly away toward the right from the ratchet-toothed edge of the carriage and rearwardly with respect to the direction of movement of the carriage, and at its farther end is pivoted on a pin portion 25 carried by an arm 28 of a bellcrank actuator 33. The bellcrank actuator 33 is pivoted on a fixed pin portion 30 carried by frame 10. The other arm 32 of the bellcrank is adapted to be actuated by the keys (not shown) of the typewriter and by the space bar (not shown) through the medium of any suitable mechanism such as is well known in the art and which normally includes a universal bar (not shown) or equivalent means for pulling the arm 32 forwardly, by means of the cord 55, whenever a key or space bar is depressed. When the arm 32 is thus moved toward the front of the machine (counterclockwise as shown in FIG. 3 and clockwise as viewed in FIG. 2), the pawl 22 is moved toward the right by arm 28, which is the rearward or retracting movement, the parts moving from the full-time position to the broken-line position shown in FIG. 3. During such retracting movement the pawl 22 pivots around the pin 25, riding up and over the tooth 20 which was to the right of the initial or full-line position of the nose 23 as viewed in FIG. 3.

Movement of the carriage 12 to the right as viewed in FIG. 3, during retraction of the pawl 22 is prevented by a detent or holding pawl generally designated 40 which has a nose portion 43 shaped similarly to the nose 23 to fit and accurately engage in the interdental spaces. The pawl 40 is pivotal in the frame 10 on a fixed pin portion 42.

The pawls 22 and 40 may be formed of a material which is sufficiently rigid for their mechanical functioning and which is also sufficiently resilient to enable the incorporation of integral spring means therein. A suitable material is an acetal resin of the composition ($-OCH_2-$) derived from polymerization of formaldehyde and available from E. I. de Pont de Nemours & Co., Wilmington, Delaware, under the trademark "Delrin". Each of the "Delrin" pawls has an integral spring arm, designated 26 in the case of the pawl 22, and 46 in the case of the pawl 40. As shown in FIG. 3, the spring arms extend rearwardly from the nose portion and angularly away from the main pawl body portions 24, 44, respectively, and engage abutment portions as 27, 47, respectively, lying farther from the nose portions of the pawl than their respective pivot pins 25, 42. The arms 26, 46, are maintained in a stressed condition and by virtue of such stressing urge the nose portions 23, 43 into the interdental spaces of the ratchet teeth. The bellcrank 33 is urged clockwise as viewed in FIGS. 1 and 3, (counterclockwise as viewed in FIG. 2), by a stressed cantilever-type wire spring 50 which urges the bellcrank in a direction to bias the pawl 22 toward the left, as viewed in FIGS. 1 and 3, and normally holds pawl 22 in a position in which its nose portion lies against a stop pin 52 on the frame member 10.

When one of the typewriter keys or the space bar of the typewriter is depressed, the bellcrank 33 is actuated by cord 55, as indicated above, and arm 28 pulls the nose portion 23 angularly toward the right and over the trailing tooth with which the right side of the nose was engaged, as noted. At the same time the nose portion 23 is continuously urged toward the toothed edge by the spring arm 26, but rearward movement of the carriage toward the right is prevented by the nose portion 43 of pawl 40, which is maintained in full engagement with the teeth by the spring arm portion 46. Due to the fact that the movement of the nose portion 23 induced by the swinging movement of the pin 25 is in an angular direction away from the toothed edge as well as toward the right, such movement of the nose 23 does not exert a strong rightward force on the carriage, as viewed in FIG. 1, and the pawl 40 is fully capable of preventing movement of the carriage in a reverse direction (toward the right), even though the spring forces of the arms 26 and 46 are relatively light. Rightward movement of the nose 23 is limited by a stop 57 engageable by bellcrank arm 32. Stop 57 permits the nose 23 to move slightly more than one full tooth space during the depression of the key, which corresponds to movement of a type bar away from the platen, or to an operative degree of depression of the space bar. Such full retracted position is shown in broken lines in FIG. 3. Upon release of the key or space bar the nose 23 again moves to the left, into full engagement with the right side of the tooth to the left of the new tooth space, and pushes the carriage to the left, as viewed in FIGS. 1 and 3, during the return stroke of the key or space bar, until the nose portion 23 again reengages the stop 52, which corresponds to one full tooth movement. It will be noted that in this position both pawls are fully seated in their respective interdental spaces. The carriage is accurately located, and held stationary, by pawl 40 while the type bar strikes, and is only moved during the return stroke when it is pushed by pawl 22.

Due to the relatively gradual slope of the teeth 20 with relation to the path of movement of the carriage and of the conforming sloping faces of the pawl nose portions 23 and 43, the carriage can be moved to the left or right by the application of direct force thereto with no damage to the parts, as the pawls will be simply cammed away and ride over the teeth. The nose 43 of pawl 40 acts as a poppet-type detent, imposing a limited restraining force to movement of the carriage. A carriage release mechanism can easily be incorporated, however, so that the carriage can be moved without ratcheting of the teeth against the pawls. As shown in the drawing, a rod 60 which may be actuatable by a carriage release bar 62 carried by the carriage is engageable with the pawl 40 and movable in a direction to swing the pawl 40 away from engagement with the ratchet teeth. The pawl 40 is in turn positioned so that its nose area, when so pushed away by the rod 60, strickes the upper portion of the pawl 22 and in turn moves it sufficiently to move its nose portion 23, together with the nose portion 43, free of engagement with the ratchet teeth 20, permitting the carriage to be freely moved without ratcheting.

This Detailed Description of the Preferred Form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A carriage actuating mechanism for a typewriter which includes a frame, a carriage movable in a linear path on the frame and a ratchet-toothed part having a linear series of teeth and movable with and parallel to the path of movement of the carriage, including an actuator having a portion supported on the frame for movement in a path generally parallel to the path of the carriage beside but spaced laterally from said ratchet teeth, a pusher pawl pivotally connected to said portion of the actuator for movement along the path of the carriage and for swinging movement toward and from interengaged relation with the ratchet teeth about its axis of pivotal connection to said portion of the actuator, said pawl being movable longitudinally with the carriage to actuate the same in response to movement of the actuator, characterized by a poppet-type detent yieldably engaging the teeth and imposing a limited restraining force to movement of the carriage, an arm portion of said pawl extending angularly forwardly and toward the teeth from the position of pivotal connection of the pawl and actuator, a nose portion carried by said arm including a forward driving face successively engageable with rear flanks of the ratchet teeth and including a rear trailing face sucessively engageable with forward flanks of the ratchet teeth, and means yieldably urging said nose portion into engagement with the teeth, both faces of said nose portion being so inclined relatively to the path of movement of the carriage that the nose portion can be cammed out of the intertooth spaces by the teeth in response to direct actuation applied to the carriage in either direction along said path of movement thereof.

2. A carriage actuating mechansim as defined in claim 1 wherein both flanks of each of said teeth are inclined at approximately 45° to the path of movement of the carriage.

3. A carriage actuating mechanism as defined in claim 1 wherein both faces of the nose of the pawl are inclined at approximately 45° to the path of movement of the carriage.

4. A carriage actuating mechanism as defined in claim 1 wherein both faces of the nose of the pawl and both flanks of each of said teeth are inclined at approximately 45° to the path of movement of the carriage.

5. A carriage actuating mechanism as defined in claim 1 wherein the pusher pawl arm and nose portion are integrally formed of a relatively resilient plastic.

6. A carriage actuating mechanism as defined in claim 1 wherein the pusher pawl arm and nose portion are integrally formed of a relatively resilient plastic, said yieldable means comprising a flexible spring arm integral with the first-mentioned arm and extending angularly therefrom in a direction generally rearwardly with respect to the direction of forward movement of the carriage and to a position rearwardly beyond said axis of pivotal connection and reacting at its rear end against an abutment on the frame in a direction to yieldably urge the nose portion toward the teeth.

7. A carriage actuating mechanism for a typewriter which includes a frame, a carriage movable in a linear path on the frame and a ratchet-toothed part having a linear series of teeth and movable with and parallel to the path of movement of the carriage, including an actuator having a portion supported on the frame for movement in a path generally parallel to the path of the carriage beside but spaced laterally from said ratchet teeth, a pusher pawl pivotally connected to said portion of the actuator for movement along the path of the carriage and for swinging movement toward and from interengaged relation with the ratchet teeth about its axis of pivotal connection to said portion of the actuator, said pawl being movable longitudinally with the carriage to actuate the same in response to movement of the actuator, characterized by a detent pawl for yieldably opposing movement of the carriage, both of said pawls and the ratchet teeth having inclined surfaces whereby the pawls can be cammed out of engagement by force applied directly to the carriage to move the same in either direction.

8. A carriage actuating mechanism as defined in claim 7 wherein a portion of the detent pawl is engageable with the pusher pawl when the detent pawl is moved away from the ratchet teeth farther than is required for full disengagement and continued movement of the detent pawl in the same direction moves the pusher pawl out of engagement with the teeth.

* * * * *